United States Patent [19]

Kokaji et al.

[11] 4,232,323

[45] Nov. 4, 1980

[54] MAGNETOGRAPHIC APPARATUS

[75] Inventors: Norio Kokaji, Hino; Kunio Kinoshita, Hachioji; Toshihiro Urano, Machida; Katsunori Saito, Akikawa, all of Japan

[73] Assignee: Iwatsu Electric Co., Ltd., Japan

[21] Appl. No.: 932,310

[22] Filed: Aug. 9, 1978

[30] Foreign Application Priority Data

Aug. 16, 1977 [JP] Japan ..... 52-98106

[51] Int. Cl.[3] ..... G03G 19/00

[52] U.S. Cl. ..... 346/74.1

[58] Field of Search ..... 346/74.1; 358/301; 360/57

[56] References Cited

U.S. PATENT DOCUMENTS

| | | | |
|---|---|---|---|
| 2,841,461 | 7/1958 | Gleason | 346/74.1 |
| 4,005,439 | 1/1977 | Levy | 346/74.1 |
| 4,030,105 | 6/1977 | Neukermans | 346/74.1 |
| 4,051,484 | 9/1977 | Martin | 346/74.1 |
| 4,072,957 | 2/1978 | Kokaji | 346/74.1 |
| 4,110,758 | 8/1978 | Nelson | 346/74.1 |
| 4,122,456 | 10/1978 | Berkowitz | 346/74.1 |

*Primary Examiner*—John H. Wolff

*Attorney, Agent, or Firm*—Merchant, Gould, Smith, Edell, Welter & Schmidt

[57] ABSTRACT

Disclosed is a magnetographic apparatus wherein a large number of copies of the same picture is produced by repeatedly using a recording drum on which a latent image of the picture is recorded, which apparatus is different from a conventional magnetographic apparatus wherein a sequence of processes consisting of a latent image recording process, a process of developing the image and a process of transferring the image is effected for production of each copy. Further disclosed herein are structural elements of a magnetographic apparatus which are suitable for producing a large number of copies of the same picture by repeatedly using a recording drum as described above.

17 Claims, 6 Drawing Figures

MAGNETOGRAPHIC APPARATUS

BACKGROUND OF THE INVENTION

This invention relates to a magnetographic apparatus.

In an apparatus utilized for magnetography or zerography of the conventional type, a sequence of processes for forming a latent image, for developing the latent image, for transferring the developed image and for erasing the latent image is conducted for the production of one copy. Such conventional type magnetographic apparatus are disclosed in, for example, U.S. Pat. Nos. 4,005,439 and 4,030,105.

However, frequent repetitions of the entire sequence of processes for forming a latent image, for developing the latent image, for transferring the developed image and for erasing the latent image for producing each copy are too complicated and too uneconomical. Furthermore, such repetitions accelerate the deterioration of the quality of the magnetic recording drum.

The inventors of the present invention conceived the idea of producing copies by repetitively using the same latent image on the drum, and made investigations into the conditions required for the apparatus utilized for producing a large number of good quality copies which repeatedly uses the same latent image on the drum.

The conditions which were investigated are as follows:

A. Access of the recording head to the recording drum.

B. Control of the magnetic force of the developing roller situated in the magnetic toner supplying portion adjacent to the surface of the recording drum.

C. Application of the electrostatic bias to the transferring portion where the developed image is transferred from the recording drum to the copy paper.

D. Utilization of the pressure fixing method in the fixing portion.

E. Selection of the optimum speed of the recording drum for the latent image formation and for the repeated copy production, respectively.

F. Selection of the material and the strength of the recording drum.

G. Selection of the material of the magnetic toner and the mixing ratio between the toner and the carrier included in the magnetic toner.

H. Selection of the method for cleaning the recording drum.

SUMMARY OF THE INVENTION

It is an object of the present invention to provide a magnetographic apparatus by which a large number of copies of the same picture is produced by repeatedly using the recording drum on which the latent image of the picture is formed.

It is another object of the present invention to provide a compact and automatically controllable magnetographic apparatus by which a large number of copies of the same picture is produced by repeatedly using the recording drum on which the latent image of the picture is formed.

It is another object of the present invention to provide a long-lasting recording drum to be used in the magnetographic apparatus by which a large number of copies of the same picture is produced by repeatedly using the recording drum on which the latent image of the picture is formed.

It is another object of the present invention to provide the most suitable magnetic toner composition to be used in the magnetographic apparatus by which a large number of copies of the same picture is produced by repeatedly using the recording drum on which the latent image of the picture is formed.

Furthermore, it is still another object of the present invention to provide a magnetographic apparatus by which the quality of each of copies of the picture is free from deterioration even in the case where a great number of copies are produced.

DETAILED DESCRIPTION OF THE PREFERRED EMBODIMENT

Figure 1:
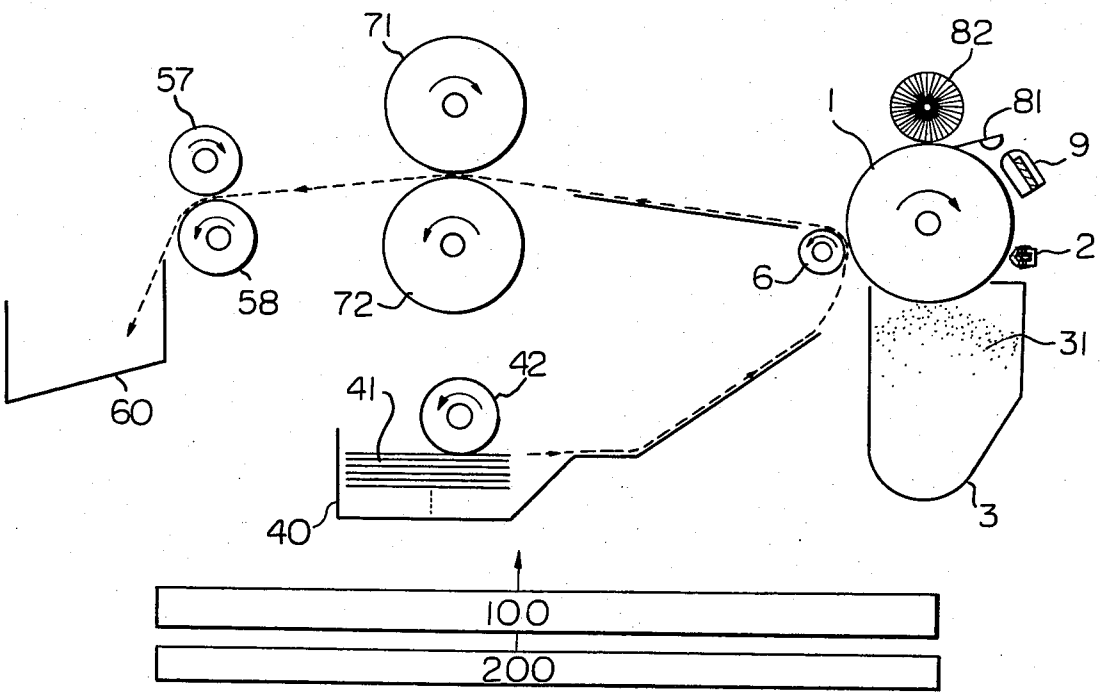
FIG. 1 shows a schematic diagram of the fundamental structure of the magnetographic apparatus in accordance with the present invention.

FIG. 1 illustrates the general structure of the magnetographic apparatus in accordance with the present invention. The apparatus comprises a magnetic recording drum 1, a magnetic recording head 2, a developing device 3 containing a magnetic toner 31, sheets of copy paper 41 stored in a paper supplying cassette 40, a paper starting roller 42, a developed image transferring roller 6, a pair of fixing rollers 71, 72, a pair of paper transporting rollers 57, 58, a cassette 60 for collecting finished copies, a rotating cleaning brush 82, a cleaning blade 81, a magnetic erasing head 9, an electrical controlling circuit 100 and a controller 200.

In the operation of the apparatus shown in FIG. 1, a residual latent image on the drum 1 is erased by the erasing head 9, a new latent image is recorded by the recording head 2 on the drum 1. By repeating a sequence of processes for developing the image by means of the developing device 3, for transferring the developed image by means of the transferring roller 6, for fixing the transferred image by means of the pair of fixing rollers 71, 72, and for collecting finished copies, by means of the pair of paper collecting rollers 57, 58 while further recording of latent images is stopped, a required number of copies of the same picture can be produced. The above-described processes of erasing the residual latent image and of recording a new latent image and the above-described sequence of processes are all controlled by the electrical controlling circuit 100 and the controller 200.

Figure 2:
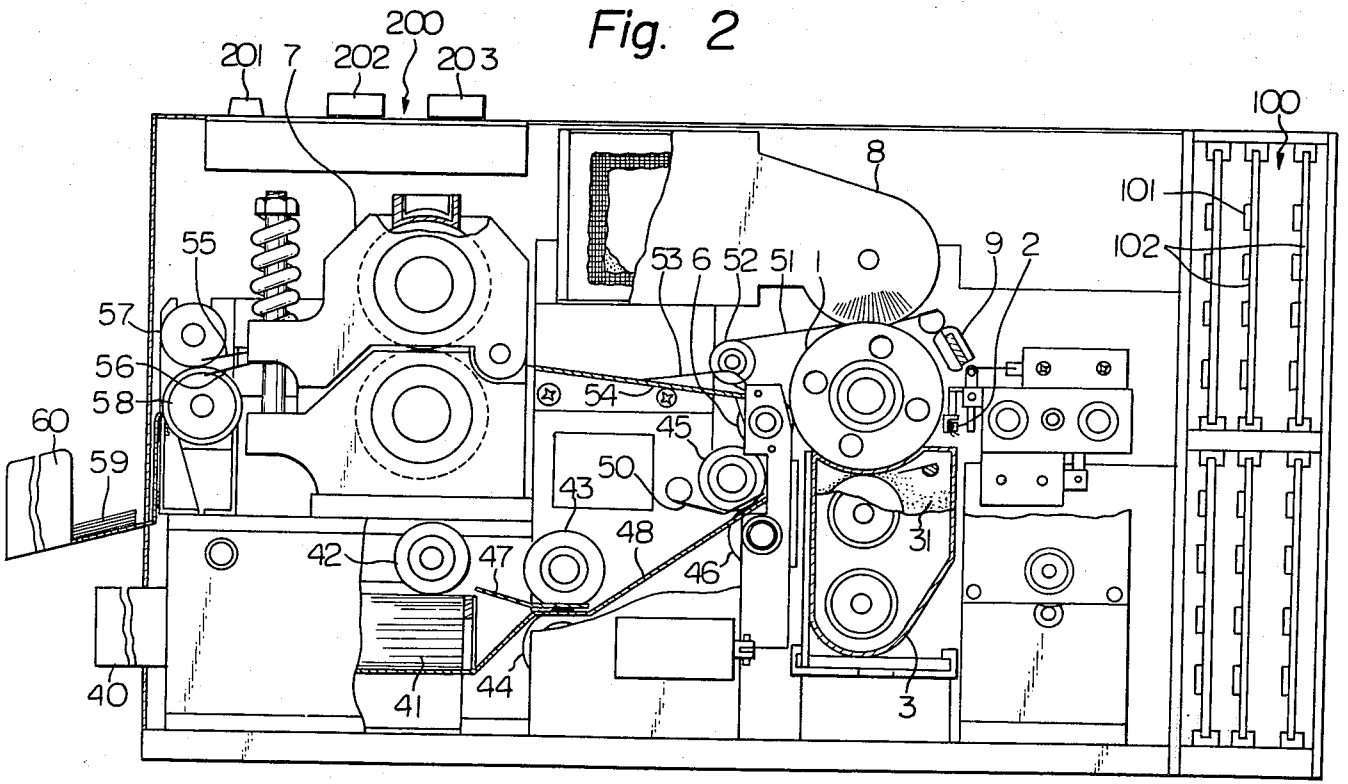
FIG. 2 shows a vertical cross-sectional view of an example of the magnetographic apparatus in accordance with the present invention.

FIG. 2 shows the apparatus of FIG. 1 in more detail. In FIG. 2, the apparatus comprises a magnetic recording drum 1, a magnetic recording head 2, a developing device 3, the magnetic toner 31, sheets of copy paper 41 stored in a paper supplying cassette 40, a paper starting roller 42, a first pair of paper transporting rollers 43, 44, a second pair of paper transporting rollers 45, 46, a sequence of paper transporting guides 47, 48, 50, a developed image transferring roller 6, a set of paper transporting guides 53, 54, a fixing device 7, a set of paper transporting guides 55, 56, a third pair of paper transporting rollers 57, 58, and a cassette 60 for collecting finished copies. An electrical controlling device 100 comprising a stack of printed circuit plates 102 with electronic components mounted thereon, such as integrated circuits or transistors, and a controller 200 comprising a push-button switch 201 and selection dials 202, 203 are all included in the apparatus shown in FIG. 2.

Figure 3:
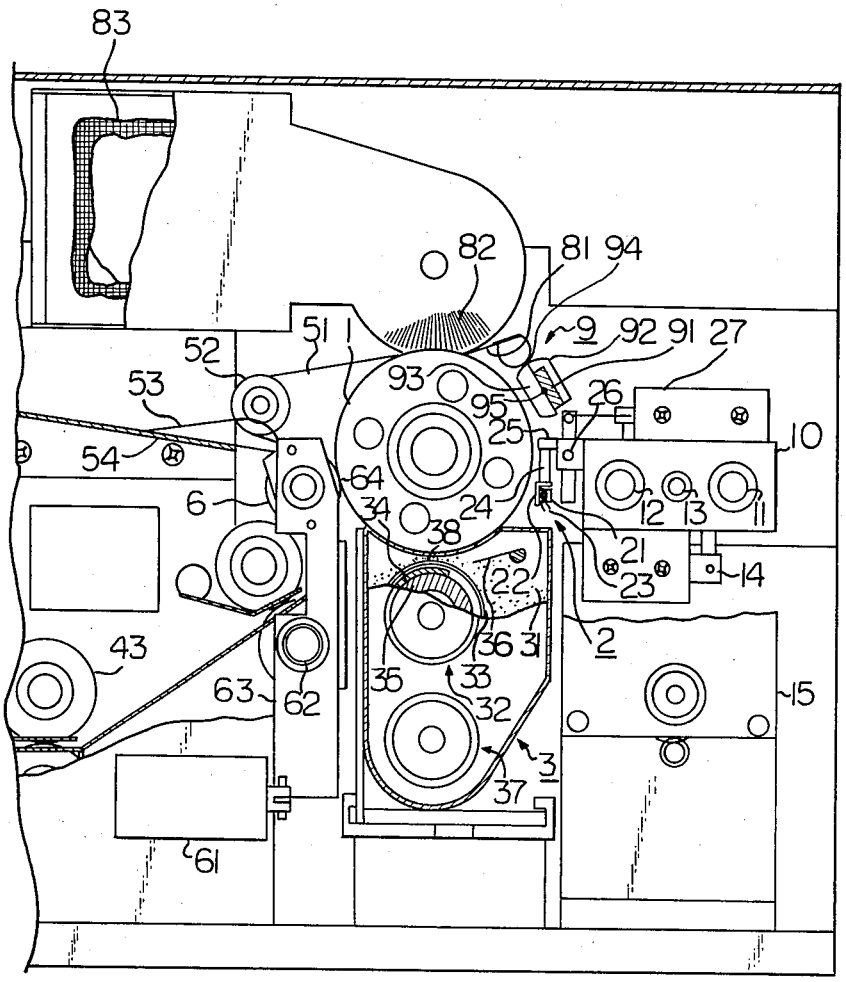
FIG. 3 shows the details of the recording drum, the recording and erasing heads, the developing portion and the transferring portion shown in FIG. 2.

FIG. 3 is a detailed illustration of a portion of the apparatus shown in FIG. 2.

In FIG. 3, the magnetic recording drum 1 consists of a base made of a nonmagnetic material such as brass, aluminum or polyvinylchloride plastics and of a thin film of magnetic material such as Co—Ni, Co—Ni—P or Co—P plated on the base. The thickness and the coercive force of the magnetic film are selected to be from 0.1 to 10 microns and from 150 to 1000 oersteds, respectively. According to the experiments made by the inventors of the present invention, the optimum values are from 0.5 to 2 microns for the thickness and from 200 to 500 oersteds for the coercive force. If the surface of the thin film of magnetic material is coated with a protective layer of a material such as nonmagnetic Ni—P, hard chromium, Rh or $SiO_2$, formed by plating or sputtering, which is from 0.1 to 10 microns in thickness, the abrasion resistant quality of the thin magnetic film is increased. The preferred hardness of the protective layer is not less than 400 degrees and more preferably not less than 600 degrees, as measured by means of a vickers hardness tester. Alternatively, $\gamma$-$Fe_2O_3$ or $CrO_2$ can be used as a material for forming the thin film, and plastics or carbon can be used as a material for forming the protective layer. The specific resistivity of the surface of the magnetic recording drum 1 is selected to be not greater than $10^{12}$ ohm.cm and preferably not greater than $10^8$ ohm.cm, in order to prevent background stains from appearing during the developing process. Preferable examples of the diameter and the rotating speed for the drain 1 during latent image recording process are 68.5 mm and 180 RPM/360 RMP/3000 RPM, respectively.

The magnetic recording head 2 comprises a magnetic core 21, a winding 23 through which the signal current is supplied, a slider 22, a spring 24, and a core holder 25. The magnetic recording head 2 approaches the drum 1 for either directly contacting the drum 1 (contact system), or for forming only a small distance of from 0.1 to 30 microns from the surface of the drum 1 (noncontact system). In general, the contact system is suitable for recording at a low drum speed, while the noncontact system is suitable for recording at a high drum speed. For the purpose of attaining a long recording head life, it is preferable to adopt the above-mentioned noncontact system. However, according to the above-described structure of the drum 1, it is also possible to maintain a sufficiently long recording head life by adopting the above-mentioned contact system. For example, in an experiment involving the contact system, in which the drum 1 had a magnetic film composed of Co—Ni—P and a protective nonmagnetic layer composed of Ni—P, the magnetic core 21 is made of Ni—Zn ferrite and the spring 24 is subjected to a contact pressure of 5 grams produced by the drum 1, the drum 1 and the recording head 2 both achieved a faultless operation even after the latent image recording was repeated for five hundred thousand times. The result of this experiment demonstrates that the drum has a remarkably extended life in view of the fact that the usual life of the drums of conventional copying machines never exceeds latent image recordings which total up to tens of thousands of times of repetitions. The above-described approach of the recording head 2 to the drum is effected by the rotation of the core holder 25 around an axis 26 caused by the force of attraction of an electromagnet 27.

The recording head 2 effects a main scanning in accordance with the clockwise rotation of the drum 1, and effects a subsidiary scanning in accordance with the traversing movement of the recording head 2 in parallel with the axis la of the drum 1. The traversing movement of the recording head 2 is caused by the traversing movement of a block 10 which supports the recording head 2, the block 10 being driven by a driving power transmitting mechanism in a casing 15. When a latent image recording process on the drum 1 is finished, the block 10 returns to the starting position, and, accordingly, the recording head 2 also returns to the starting position. The traversing movement and the returning movement of the block 10 are both controlled by an electromagnet 14.

It is possible to provide a plurality of recording heads, although only a single recording head 2 is shown in FIG. 3. Furthermore, it is also possible to adopt an electronic scanning system by arranging a sequence of recording heads along the subsidiary scanning line, instead of adopting the above-described mechanical subsidiary scanning.

The magnetic toner 31 used for the copying of the latent image on the drum 1 consists of a magnetic powder component for developing the latent image, and plastic and wax components for transferring and fixing the developed image to a copy paper. The magnetic toner can contain either one single kind of particles or two different kinds of particles. The material of the magnetic powder may be selected from substances of a high permeability, for example, pure iron, triiron tetroxide or nickel. In the case where a mixture of two different kinds of particles is used, the diameter of each particle should preferably be from 5 to 50 microns. In the case where a single kind of each particle is used, the diameter of the particle should preferably be from 5 to 40 microns. The diameter of each particle of magnetic powder which is mixed with plastic and wax should not be greater than 5 microns and particularly not greater than 1 micron. A preferable amount of the magnetic powder component in the magnetic toner should be from 40 to 80 weight percent and particularly from 50 to 70 weight percent.

The plastic material may be selected from a substance having a softening point of 70° C. to 200° C., for example, cellulose ester such as ethylene vinylacetate copolymer, cellulose ether vinyl resins such as polyvinylbutyral, acrylic acid resins such as N-butylmethacrylate, styrene resins, or epoxy resins. A preferable amount of the plastic in the magnetic toner should be less than 15 weight percent.

The wax material may be selected from a substance having a melting temperature of from 50° C. to 130° C., for example, a wax of an aliphatic compound such as paraffin; drivatives of an aliphatic acid such as ethyleneglycol hydroxystearylate, hydroxy stearic acid or caster wax; a metallic salt of aliphatic acids such as aluminum stearate; and amidehydroxy waxes such as N(2-hydroxyethyl)-12-hydroxy stearamide. A preferable amount of wax in the magnetic toner should be from 20 to 60 weight percent and particularly from 25 to 50 weight percent.

A preferable amount of plastic in the magnetic toner used for thermal fixing should be from 20 to 60 weight percent and particularly from 30 to 50 weight percent, the above-mentioned wax being unnecessary. On the contrary, it is possible for the amount of plastic in the magnetic toner used for pressure fixing to be zero.

A fluidizing agent such as amorphous colloidal silica of approximately 0.1 weight percent may be added to the magnetic toner in order to increase the fluidity of the magnetic toner. Dyestuff, pigment, or electrically conductive powder such as carbon black may be added to the magnetic toner in order to control the color or resistivity of the magnetic toner. Carbon black is added to a magnetic toner comprising of a pure magnetic iron powder in order to obtain a black color magnetic toner, although such an addition is not necessary for a black color magnetic toner comprising of a magnetic triiron tetroxide powder. It is also possible to obtain a magnetic toner of a yellow, magenta or cyan color. The resistivity of such magnetic toner is controlled by adding a selected quantity of carbon black.

The magnetic toner 31 is applied to the drum 1 by the counterclockwise rotation of a developing sleeve 33 of a developing roller 32. The magnetic toner is attracted by the magnetic force of a permanent magnet located inside of the developing sleeve 33 and is thereby transported to the surface of the drum 1 in accordance with the rotation of the developing sleeve 33. The magnetic field existing in the region 38 where surfaces of the drum 1 and the developing sleeve 33 form the shortest distance is weakened since magnetic shielding plate 34 made of electromagnetic soft iron or pure iron is provided adjacent to the region 38. The weakened magnetic field in the region 38 should not be greater than 300 gauss and preferably not greater than 150 gauss. The magnetic field existing in the magnetic toner transporting zone except in the region 38 may be greater than 300 gauss. If the magnetic field caused by the permanent magnet 35 is too strong in the region 38, the magnetic attraction caused by the latent image on the drum 1 will not be able to attract the magnetic toner well enough to ensure a successful development of the latent image on the drum 1. Furthermore, such a strong magnetic field will erase the magnetic latent image on the drum 1. A plate 36 is used for controlling the level of the magnetic toner in the developing device 3 in order to control the quantity of magnetic toner to be applied to the drum 1. The preferable length of the gap 38 between the drum 1 and the sleeve 33 is approximately 0.5 mm to 3 mm, and the preferable level of the surface of the toner 31 is approximately 0.1 mm to 2 mm above the gap 38. The conveying roller 37 is provided in the developing device 3 for the purpose of increasing the amount of the toner 31 stored in the developing device 3.

The transferring roller 6 is kept apart from the drum 1 during the period of recording a latent image on the drum 1. After copying of a recorded latent image is started, the transferring roller 6 is coupled with the drum 1 in accordance with the clockwise rotation of an arm 63 around an axis 62 caused by the force of attraction of an electromagnet 61, and then holds a copy paper at the coupling gap 64 formed between the transferring roller 6 and the drum 1.

The transferring roller 6 should preferably be made of dielectrics having an isocyanate radical such as polyurethane resin, polyurethane rubber or polyamide resin such as nylon; an example of such dielectrics is vulcollan 3 which is a product of Bayer Co. of West Germany. The hardness of the transferring roller 6 should preferably be from 10 to 50 degrees.

A voltage is applied between the transferring roller 6 and the drum 1 in order to increase the transferring efficiency. The applied voltage should preferably be from 100 to 1500 D.C. volts in the case where the transferring roller comprises an aluminum core and a urethane rubber layer having a hardness of 30 degrees and a thickness of 2.5 mm for obtaining a good image transfer result. Electrically charged magnetic toner attached to the surface of the drum 1 is transferred to a copy paper inserted into the gap 64 due to the electrostatic attraction caused by the voltage applied between the drum 1 and the transferring roller 6. No voltage may be applied or a voltage of a reversed polarity may be applied between the drum 1 and the transferring roller 6 during the period of recording a latent image on the drum 1 when the copying process is stopped, in order to prevent the deterioration of the dielectric layer of the transferring the roller 6. The transferring roller 6 may be cleaned by utilizing a cleaning means.

The sheet of copy paper which goes through the coupling gap 64 formed between the transferring roller 6 and the drum 1 is separated from the surface of the drum 1 due to the removing action of a paper removing belt 51 (shown in FIG. 3) which is wound around a tension roller 52 (shown in FIG. 3) and the edge portion of the drum 1. Then the copy paper, onto which the developed image is transferred from the drum 1 at the coupling gap 64, is transported towards the fixing device 7 (shown in FIG. 2), each side of the copy paper being respectively guided by a guide plate 53 (shown in FIGS. 2 and 3) and a guide plate 54 (shown in FIGS. 2 and 3).

Figure 4:
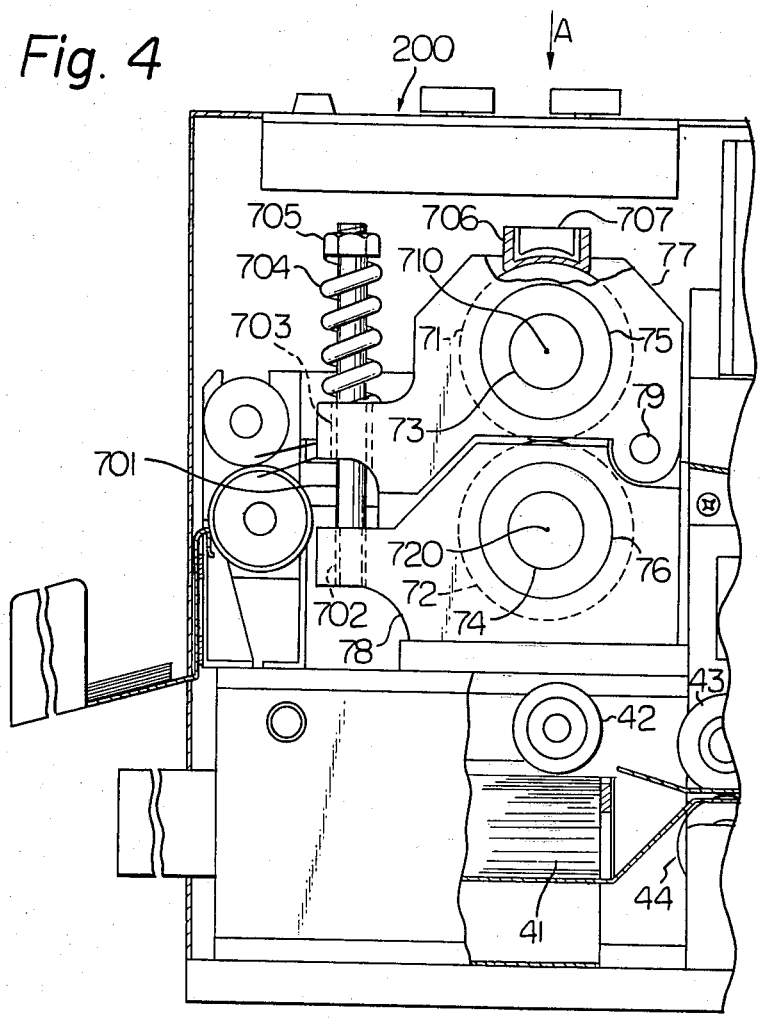
FIG. 4 shows the details of the transferred image fixing portion of FIG. 2.

FIG. 4 shows the details of the fixing device of the pressure fixing type. The shafts 73 and 74 of the fixing rollers 71 and 72 are supported by the bearings 75 and 76 arranged in the supporting members 77 and 78. Both the upper supporting member 77 and the lower supporting member 78 are coupled together by means of an axle 79. A pillar 701, which is screwed to the lower supporting member 78 and which penetrates a hole 703 located in the upper supporting member; a nut 705 screwed to the pillar 701; and a spring 704 altogether provide a means for combining the upper and lower supporting members 77, 78 together. By pressing down the upper supporting member 77 towards the lower supporting member 78 by means of the screw 705, the upper fixing roller 71 is pressed to the lower fixing roller 72.

Figure 5:
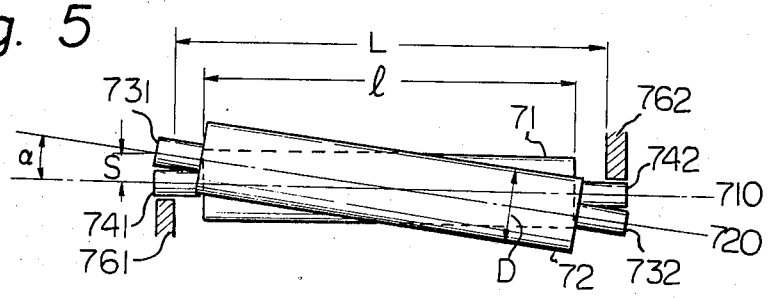
FIG. 5 shows the relationship between two pressure rollers in the transferred image fixing portion of FIG. 2.

The relationship of the fixing rollers 71, 72 is shown in FIG. 5, which is view taken in the direction of the arrow A in FIG. 4. The central axis 710 of the roller 71 and the central axis 720 of the roller 72 form a predetermined angle $\alpha$ therebetween. The angle $\alpha$ is determined by the values of the elastic coefficient, length, diameter, load and other factors of the rollers. A suitable example of the angle $\alpha$ is described as follows: that is, the angle $\alpha$ will be 1.46° and the deviation "S" of axes 710 and 720 at the ends 731 and 741 will be 3.89 mm, respectively, under the condition that the length l of the roller is 320 mm, the diameter D of the roller is 60 mm, the distance L between two bearings 761 and 762 for the shaft 74 (FIG. 4) is 312 mm, the entire load for rollers 71 and 72 is 1800 kg. The copy paper is A4 in size (i.e., 210 mm×297 mm) and the copy paper is supplied between the rollers 71 and 72 in such a manner that the longer side is parallel with the axes of the rollers.

According to the experiments performed by the inventors of the present invention, an approximate equation of $\alpha \approx \tan^{-1}(4\sqrt{\delta(D-\delta)}/l)$ is obtained, where $\delta$ is the deflection of the roller.

The material of the rollers 71, 72 is selected so as to provide a high hardness, preferably higher than 700 degrees as measured by means of the Vickers hardness tester, a smooth surface, a shockproof characteristic, a high stiffness and facile processing. The rollers 71, 72 should preferably be made of alloy tool steel SKD-11 having a layer of hard chrominum plating, the surface of such layer being polished and the thickness of such polished layer being preferably from 0.01 mm to 0.1 mm. The above-mentioned hard chromium plating may be replaced by a silicon carbide coating.

A ball bearing, a roller bearing or a needle roller bearing of a heavy load rating may be used as the bearings 75, 76 (FIG. 4). However, the most suitable type of bearing to be used as the bearings 75, 76 is the self-aligning bearing.

The above-described pressure fixing device can be replaced by a thermal fixing device.

Referring again to FIG. 3, a cleaning device 8 includes the blade 81, the rotating brush 82 and a filter 83. A part of the toner on the drum 1, which part remains to be attracted after the transfer of the developed image is effected by the transferring roller 6, is first swept off by the rotating brush 82. Thereafter, the portion of the toner remaining on the drum 1 due to magnetic attraction caused by the remaining magnetic latent image is scraped off by the blade 81 and then swept off by the rotating brush 82. The toner attached to the rotating brush 82 is then separated from the rotating brush 82 by a beating plate (not shown in Figs.) and then conveyed to the filter 83 by air absorbing means (not shown in Figs.). The rotating brush should preferably be made of viscose rayon. The material suitable for forming the blade 81 should be a hard and flexible metallic sheet such as a brass or phosphor bronze sheet.

The erasing head 9, consisting of a permanent magnet 91 and a set of soft magnetic housings 92 and 93 with a gap 94 between them, rotates around its axis 95 so that the gap 94 can be at a position closest to the surface of the drum 1. The entire recorded latent image on the drum 1 can be erased by means of the erasing head 9 during one revolution of the drum 1. The erasure of the recorded magnetic latent image is effected after a required number of copies of the recorded magnetic latent image is produced and before the recording of the next magnetic latent image on the drum 1 is effected by the recording head 2. The above-described permanent magnetic erasing head may be replaced by that of an electromagnetic type. It is possible to omit the erasing head in the case where the recording of a new magnetic latent image by the recording head inevitably results in a perfect erasure of the last recorded magnetic latent image.

Papers prepared for general printing uses can also be utilized for copying purposes involving the apparatus of the present invention. Papers having the highly stable resistivity due to special treatments thereof, as used with plain paper copiers (PPC), may also be utilized with the present apparatus.

In an experiment pertaining to the operation of the magnetographic apparatus illustrated in FIG. 2, it was observed that the production of approximately one hundred thousand copies of one picture was achieved to such a satisfactory degree that the quality of the last produced copy was not at all inferior to that of the first produced one. On the basis of the above-described experimental results, it is considered possible to produce more than one hundred thousand copies of one picture by means of the apparatus of the present invention.

Figure 6:
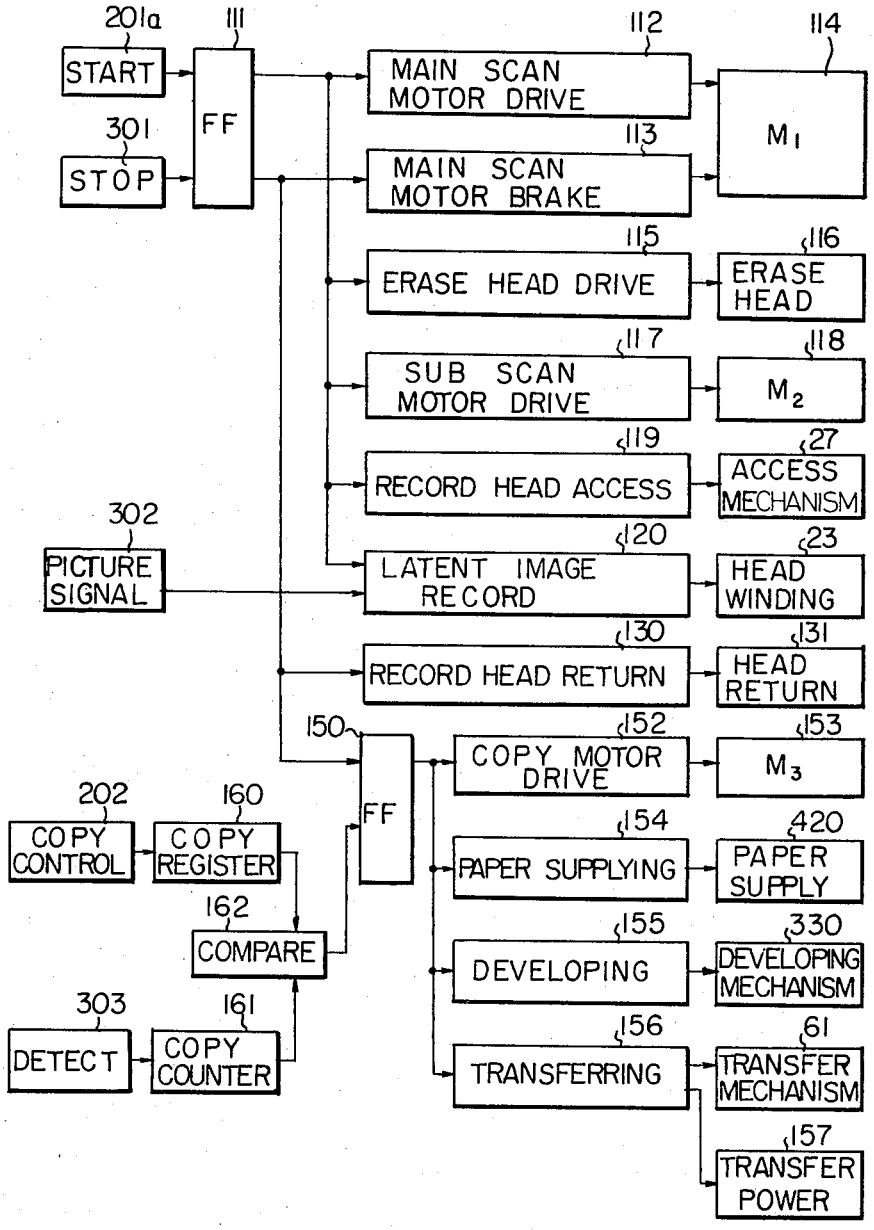
FIG. 6 shows an example of the block diagram of an electrical device for controlling the magnetographic apparatus in accordance with the present invention.

The control of the magnetographic apparatus shown in FIG. 2 will be described hereinafter with reference to the block diagram of the electrical device shown in FIG. 6.

A. Erasure of the Recorded Magnetic Latent Image on the Recording Drum

The switching-on of a starting switch 201*a* causes a flip-flop unit 111 to attain a "set" status. A driving circuit 112 for a main scanning motor 114 is activated by an output signal of the flip-flop unit 111. The main scanning motor 114 starts to drive the recording drum upon receiving an output signal of the driving circuit 112.

Simultaneously, a driving circuit 115 for the erasing head is activated by the output signal of the flip-flop unit 111. A driving mechanism 116 for the erasing head causes the erasing head to rotate so that the gap is at a position which is nearest to the surface of the drum. Then, the erasing head effects the erasing of the last recorded magnetic latent image.

B. Recording of a Magnetic Latent Image on the Recording Drum

A driving circuit 117 utilized for a subsidiary scanning 118 is activated by the output signal of the flip-flop unit 111. The subsidiary scanning motor 118 starts to drive the recording head in the direction of the subsidiary scanning.

Simultaneously, a recording head access circuit 119 is activated by the output signal of the flip-flop unit 111. The electromagnet 27 is energized by the recording head access circuit 119. The recording head 2 is caused to approach toward the drum due to the energizing of the electromagnet 27. Then a recording signal circuit 120 receives the picture signal 302. The recording head winding 23 is supplied with an output signal of the recording signal circuit 120. Thus the recording of a magnetic latent image corresponding to the picture signal is effected on the drum.

After the recording of a latent image on the drum is completed, produced by the signal source 301 a stop signal causes the flip-flop unit 111 to attain a "reset" status. The driving circuit 112 for the main scanning motor is shut down and a braking circuit 113 for the main scanning motor is activated by the output signal of the flip-flop unit 111. Thereby the rotation of the main scanning motor is stopped.

Simultaneously, a recording head return circuit 130 is activated, and the recording head access circuit 119 is shut down by the output signal of the flip-flop unit 111. The movement of the recording head in the direction of the subsidiary direction is stopped, and the recording head returns to its original position.

The recording of the latent image is preferably effected in such a manner that the magnetic field of the alternating direction is applied in response to the black colour of the picture and the saturation magnetic field of a predetermined direction is applied in response to the white colour of the picture. The details of this manner of recording are disclosed in U.S. patent application Ser. No. 875,010.

C. Production of Copies, of a Recorded Magnetic Latent Image on the Drum

When the flip-flop unit 111 has attained the "reset" status as described above, a flip-flop unit 150 will attain a "set" status. A copying motor driving circuit 152, a copy paper supplying circuit 154, a developing circuit 155, and a transferring circuit 156 are all activated simultaneously by the output signal of the flip-flop unit 150. A copying motor 153 starts to drive the drum 1 at the latent image copying speed. A copy paper supplying mechanism 420 starts to transport a copy paper from the paper supplying casette through a sequence of paper transporting guides to the coupling gap located between the drum and the transferring roller. A developing mechanism 330 starts to supply the magnetic toner to the surface of the drum due to the rotation of the developing drum. A transferring mechanism 61 causes the transferring drum to couple with the drum, thus allowing copying papers to pass through the gap located betwen the drum and the transferring roller. A transferring power source 157 starts to supply the voltage to the transferring roller.

Before the flip-flop unit 150 attains a "set" status as mentioned above, the required number of copies is registered in a copy register 160 in accordance with the operation of a copy controller 202. After the transporting of the copy papers by the paper supplying mechanism 420 is started, the number of transported copy papers is counted by a copy counter 161 in accordance with an output signal of a detector 303 for detecting the transported copy papers.

The outputs of the copy register 160 and copy counter 161 are compared by the comparator 162. When the output of the copy counter 161 reaches the same value as the value of the output of the copy register 160, the comparator 162 produces a copy stopping signal which is applied to the flip-flop unit 150 so that the flip-flop unit 150 is turned to the "reset" status. When the flip-flop unit 150 is turned to the "reset" status, the copying motor driving circuit 152, the copy paper supplying circuit 154, the developing circuit 155, and the transferring circuit 156 are shut down in accordance with a predetermined sequence. Thus, the production of copies of a recorded magnetic latent image on the drum is completed, and the copy counter 161 is set back to its original status.

What is claimed is:

1. A magnetographic apparatus comprising:

(a) a device for generating a magnetic latent image pattern signal;

(b) a rotatable magnetic recording drum having a layer of metallic plating, wherein the specific resistivity of the surface of said drum is not greater than $10^{12}$ ohmcentimeter;

(c) a magnetic recording head for recording magnetic latent images having a magnetic field of predetermined strength on said drum in accordance with said magnetic latent image pattern signal;

(d) a developing device which supplies magnetic toner to said recording drum for developing said magnetic latent images into visible images formed by adhered toner, wherein said developing device comprises:

(i) a rotatable developing surface located adjacent the drum;

(ii) at least one magnet for developing a magnetic field to hold the toner on the developing surface, wherein the magnetic field of the magnet is sufficiently weak in the region where the developing surface is nearest the drum such that the magnetic field of the magnetic latent images attracts the the toner from the developing surface and the magnetic field of the magnet does not erase the magnetic latent images;

(e) a transferring device for electrostatically transferring said magnetic toner adhered to said magnetic latent images to a recording sheet;

(f) a fixing device for fixing said magnetic toner transferred to said recording sheet;

(g) a cleaning device having a blade in the shape of a metallic plate for cleaning the remaining magnetic toner on said recording drum;

(h) a recording sheets conveying device, and (i) a control device for controlling a magnetic latent image recording process and causing the repetition of a sequence of processes consisting of a developing process, a transferring process, a process for fixing images and a process for conveying recording sheets whereby a plurality of individual copies of said magnetic latent image may be formed from a single magnetic image after said latent image is initially recorded on said drum.

2. An apparatus as defined in claim 1, wherein the recording head is mounted on an access mechanism.

3. An apparatus as defined in claim 1, wherein the recording head is kept in a noncontact relationship with the recording drum.

4. An apparatus as defined in claim 1, wherein the recording head is in contact with the recording drum due to the action of a spring.

5. An apparatus as defined in claim 1, wherein the developing device comprises at least one fixed magnet and wherein the developing surface comprises a sleeve rotating around said fixed magnet.

6. An apparatus as defined in claim 1, wherein the transferring device consists of a dielectric roller supplied by an electrostatic bias.

7. An apparatus as defined in claim 6, wherein the dielectric roller is made of urethane.

8. An apparatus as defined in claim 1, further comprising an erasing head which covers the entire length of the recording drum.

9. An apparatus as defined in claim 8, wherein the erasing head operates immediately before the recording of a magnetic latent image on the recording drum.

10. An apparatus as defined in claim 1, wherein the recording drum has a protective layer of nonmagnetic material.

11. An apparatus as defined in claim 1, wherein the magnetic toner contains 40 to 80 weight percent of magnetic power, 0 to 15 weight percent of resins and 20 to 60 weight percent of waxes, wherein said toner possesses fluidity and wherein said toner is capable of being fixed by pressure.

12. An apparatus as defined in claim 1, wherein the magnetic toner contains 40 to 80 weight percent of magnetic powder, 20 to 60 weight percent of resins, wherein said toner possesses fluidity and wherein said toner is capable of being fixed by heat.

13. An apparatus as defined in claim 1, wherein the recording of the latent image is effected in such a manner that the magnetic field of the alternating direction is applied in response to the black colour of the picture and the saturation magnetic field of a predetermined direction is applied in response to the white colour of the picture.

14. An apparatus as defined in claim 1, wherein the tranferring device comprises a transferring roller having an isocyanate radical and having a hardness of from 10 to 50 degrees.

15. An apparatus as defined in claim 14, wherein a voltage of from 100 to 1500 D.C. volts is applied between the transferring roller and the magnetic recording drum during a copying process.

16. An apparatus as defined in claim 15 wherein no voltage is applied or a voltage of a reversed polarity is applied between said transferring roller and said drum during the period of recording a latent image on said drum.

17. An apparatus as defined in claim 1, wherein said magnetic field developed by the magnet associated with the developing surface is not greater than 300 gauss.

* * * * *